US009562736B2

(12) United States Patent
Grossnickle et al.

(10) Patent No.: US 9,562,736 B2
(45) Date of Patent: Feb. 7, 2017

(54) ELECTROMAGNETIC MUZZLE VELOCITY CONTROLLER AND BOOSTER FOR GUNS

(71) Applicant: The Boeing Company, Chicago, IL (US)

(72) Inventors: James A. Grossnickle, Bellevue, WA (US); Dejan Nikic, Seattle, WA (US)

(73) Assignee: The Boeing Company, Chicago, IL (US)

( * ) Notice: Subject to any disclaimer, the term of this patent is extended or adjusted under 35 U.S.C. 154(b) by 422 days.

(21) Appl. No.: 14/282,376

(22) Filed: May 20, 2014

(65) Prior Publication Data

US 2016/0245613 A1 Aug. 25, 2016

(51) Int. Cl.

| | |
|---|---|
| ***F41B 6/00*** | (2006.01) |
| ***F41A 31/00*** | (2006.01) |
| ***F41A 21/32*** | (2006.01) |

(52) U.S. Cl.

CPC ..... *F41B 6/003* (2013.01); *F41A 21/32* (2013.01); *F41A 31/00* (2013.01)

(58) Field of Classification Search

CPC ..... F41B 6/003; F41A 21/32; F41A 31/00
USPC ..... 124/3
See application file for complete search history.

(56) References Cited

U.S. PATENT DOCUMENTS

| | | | | |
|---|---|---|---|---|
| 2,235,201 | A | 3/1941 | Cole | |
| 3,271,032 | A * | 9/1966 | Rabinowitz | F41A 33/02 250/215 |
| 3,611,783 | A | 10/1971 | Mittelmann | |
| 4,926,741 | A | 5/1990 | Zabar | |
| 4,966,884 | A | 10/1990 | Hilal | |
| 5,024,137 | A * | 6/1991 | Schroeder | F42B 6/006 124/3 |
| 5,168,118 | A * | 12/1992 | Schroeder | F42B 6/006 124/3 |
| 7,111,619 | B2 * | 9/2006 | Schneider | F41B 6/003 124/8 |
| 2004/0112205 | A1 | 6/2004 | MacDougall | |

* cited by examiner

*Primary Examiner* — Samir Abdosh
(74) *Attorney, Agent, or Firm* — Ostrager Chong Flaherty & Broitman P.C.

(57) ABSTRACT

Systems and methods for electromagnetically controlling the muzzle velocity of a conventional gun using a coil gun on a barrel extension. This method can also provide an electromagnetically induced increase to muzzle velocity beyond that capable by conventional explosives. With higher muzzle velocity, the weapons will have longer range, higher penetrating power and stand-off distances. A section of coil gun can also be used to center the projectile in the barrel to control the exit trajectory. Using a coil gun to control muzzle velocity and center the projectile can be a retrofit to existing weapons that would greatly increase their down-range accuracy.

18 Claims, 8 Drawing Sheets

ELECTROMAGNETIC MUZZLE VELOCITY CONTROLLER AND BOOSTER FOR GUNS

BACKGROUND

This disclosure generally relates to systems and methods for improving the accuracy of large guns.

Conventional guns (such as the M198 or M777 155-mm howitzer or large naval guns) rely on chemical propellants which limit their muzzle energy, range, and down-range accuracy. Multiple factors (such as powder temperature) may cause the muzzle velocity of a conventional projectile to vary a few percent from nominal. In some guns a change of just 1° C. in the chemical propellant can cause a 1.5 m/sec change in muzzle velocity, where every 1 m/sec variation from nominal muzzle velocity in a conventional projectile means the ordinance will be off target 30-40 m down range. For example, a 3% deviation from a nominal muzzle velocity of 800 m/sec is 24 m/sec, which could cause the projectile to be delivered almost 1 km away from its desired target. Conventional guns also suffer from barrel wear as they fire more and more rounds. Barrel wear may cause the projectile to leave the gun slightly off center, resulting in a potentially unpredictable trajectory, thereby further reducing down-range accuracy. Additionally, current weapons systems have reached a limit for muzzle velocity with existing explosives.

Coil guns are electromagnetic guns that use the Lorentz force to accelerate a projectile with a conducting armature. For high-speed applications, induction coil guns use magnetic coupling to drive current in the armature without direct electrical contact between the barrel and projectile. Some induction coil guns consist of short-length, solenoidal electromagnets that are stacked end to end. The coils are energized sequentially to create a wave of electromagnetic energy moving from breech to muzzle in order to accelerate the armature. Active tracking of the projectile location during launch provides precise feedback to control when the coils will be triggered to create the electromagnetic wave that propels the projectile.

Existing solutions of bringing electromagnetically propelled weaponry to the battlefield require complete re-design and re-build of existing systems. There is presently no electromagnetic solution known to the authors that can be installed or mounted on existing weapons platforms without major modifications. There is also no known solution to controlling muzzle velocity of conventional guns that use chemical propellant. Guided munitions can be used to control accuracy, but they are very expensive compared to unguided munitions.

It would be desirable to provide a system that can actively control the muzzle velocity of a projectile as it leaves a gun by detecting the velocity of the projectile as it leaves the gun and then adjust its velocity to a target velocity. Preferably this system would be easily retrofit onto existing guns so that minimal or no re-design of the gun or projectile would be necessary.

SUMMARY

The subject matter disclosed in detail below is directed to systems and methods for electromagnetically controlling the muzzle velocity of a conventional gun using a coil gun on a barrel extension. This method can also provide an electromagnetically induced increase to muzzle velocity beyond that capable by conventional explosives. With higher muzzle velocity, the weapons will have longer range, higher penetrating power and stand-off distances. A section of coil gun can also be used to center the projectile in the barrel to control the exit trajectory. Using a coil gun to control muzzle velocity and center the projectile can be a retrofit to existing weapons that would greatly increase their down-range accuracy.

In accordance with the embodiments disclosed herein, a section of coil gun can be attached to the end of a conventional gun barrel (similar to installation of a suppressor on small arms) and used to electromagnetically control the muzzle velocity of a conventional projectile fired from that gun barrel. A short section (e.g., ~1 m) of coil gun, with active feedback fire control, attached to the end of a conventional gun can be used to control, and even enhance, the muzzle velocity of a conventional gun. A longer section of coil gun could be used to significantly enhance the muzzle energy of a conventional projectile. These coil guns can be designed to retrofit onto an existing platform and require minimal if any changes to the projectile.

The systems In accordance with the embodiments disclosed herein further comprise detection electronics for detecting the muzzle velocity of the projectile as it exits the gun barrel and high-current, high-voltage switching circuits which connect the coils of the coil gun to a compact self-contained source of electrical power. The power supply may comprise a multiplicity of moderately high-energy-density capacitors and a generator (for charging the capacitors) that can be mounted on a tank or, in the case of artillery, in a small truck or trailer.

One aspect of the subject matter disclosed in detail below is a system that is capable of firing a projectile using chemical propellant, which system comprises: a gun barrel having a muzzle; a barrel extension attached to the muzzle of the gun barrel, the barrel extension being coaxial with the gun barrel; a multiplicity of electrically conductive coils arranged in sequence along the axis of the barrel extension and surrounding respective axial portions of the barrel extension; a multiplicity of sources of electrical current; a multiplicity of switches, each of the switches being connected to a respective coil and to a respective source of electrical current; a sensor system capable of detecting positions of a projectile as it exits the muzzle; and control electronics programmed or configured to alter the state of one or more of the multiplicity of switches based on signals output by the sensor system. The gun barrel may be part of a tank, a howitzer, a naval gun, a rifle, or other similar large gun.

In accordance with some embodiments of the system described in the preceding paragraph, the control electronics are programmed or configured to perform the following operations: (a) generate data representing a present velocity of the projectile based on the signals output by the sensor system; (b) compare the data representing a present velocity of the projectile with data representing a target velocity of the projectile; and (c) generate switching control signals for controlling the state of the switches in a manner that causes the coils to generate electromagnetic forces that reduce a difference between the present and target velocities.

In accordance with some embodiments, the sensor system comprises: a first sensor configured and located to send a first signal when a portion of a projectile arrives at a first axial position at a first time; and a second sensor configured and located to send a second signal when said portion of the projectile arrives at a second axial position at a second time subsequent to said first time. Operation (a) may comprise calculating the present velocity based on a distance between the first and second sensors and a time interval separating the first and second times. The states of the switches can be controlled to cause at least one of the coils to generate an electromagnetic force which will increase or decrease the velocity of a projectile depending on whether the present velocity is less or greater than the target velocity.

In accordance with one implementation, the sources of electrical current comprise respective capacitor banks; each capacitor bank is connected to a respective switch; and each sensor may comprise a respective light emitter and a respective photodetector arranged to receive light from the respective light emitter.

In an embodiment that regulates the projectile velocity, the coils may be configured to have the same risetime, voltage, and current. For an embodiment that increases the projectile velocity, those parameters would need to change for coils downstream of the projectile for increased velocity.

Another aspect of the subject matter disclosed herein is a method for retrofitting a gun that is capable of firing a projectile using chemical propellant. The retrofitting method comprises: mounting a multiplicity of electrically conductive coils at spaced intervals outside and along a length of barrel extension having a smooth bore; and coupling the barrel extension to the barrel of a gun such that the smooth bore of the barrel extension is aligned with a smooth bore of the gun barrel. In some embodiments, the gun further comprises a muzzle brake attached to a muzzle of the gun barrel, the barrel extension being attached to the muzzle brake. Again the gun may be a tank, a howitzer, a naval gun, a rifle, or other similar large gun.

A further aspect is a method for adjusting a velocity of a projectile propelled by a gun using chemical propellant, the method comprising: (a) igniting chemical propellant to cause a projectile to be propelled from a breech to a muzzle of a gun barrel; (b) determining a present velocity of the projectile after at least a portion of the projectile has exited the muzzle; (c) comparing the present velocity determined in step (b) to a target velocity; and (d) adjusting the velocity of the projectile by generating an electromagnetic force in a space that is forward of the muzzle in dependence on the results of step (c). In the disclosed embodiments, step (d) comprises energizing one or more electrically conductive coils disposed forward of the muzzle to increase or decrease the projectile velocity depending on whether the present velocity is less or greater than the target velocity.

In accordance with some embodiments, steps (b) through (d) are iteratively performed until the present velocity differs from the target velocity by less than a specified threshold. In accordance with other embodiments, step (d) comprises energizing multiple coils in accordance with a specified firing sequence which is selected in dependence on the magnitude of the difference between the present and target velocities.

Yet another aspect of the subject matter disclosed herein is an apparatus for launching a projectile comprising: a first gun barrel section having a breech and a muzzle; a second gun barrel section coupled to and aligned with the first gun barrel section; a multiplicity of electrically conductive coils arranged in sequence along the second gun barrel section and surrounding respective axial portions of the second gun barrel section; a multiplicity of switches connected to respective coils of the multiplicity of coils; and a multiplicity of capacitor banks connected to respective switches of the multiplicity of switches. This apparatus may further comprise a muzzle brake attached to and disposed between the first and second gun barrel sections. In accordance with various embodiments, the first gun barrel section is a barrel of a tank, a howitzer, a naval gun, a rifle, or other similar large gun.

Other aspects of improved systems and methods for electromagnetically controlling or boosting the muzzle velocity of a large gun are disclosed below.

BRIEF DESCRIPTION OF THE DRAWINGS

Reference will hereinafter be made to the drawings in which similar elements in different drawings bear the same reference numerals.

DETAILED DESCRIPTION

Figure 1A:
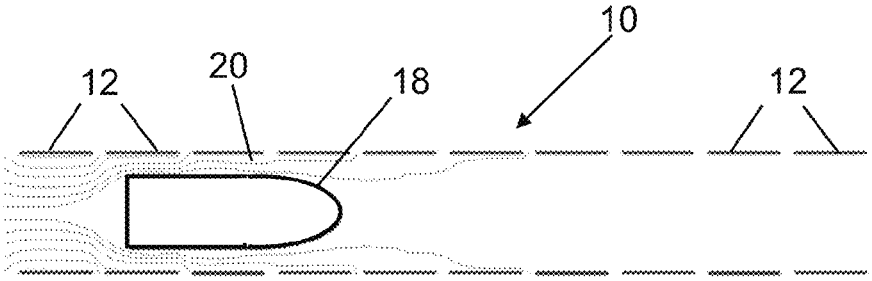
FIGS. 1A through 1C are diagrams illustrating respective positions at respective instances of time of a projectile being accelerated by a coil gun.
Figure 1B:
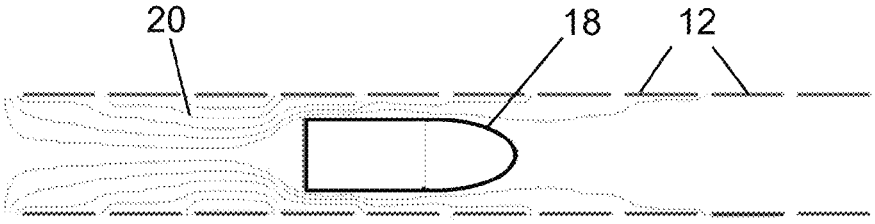
Figure 1C:
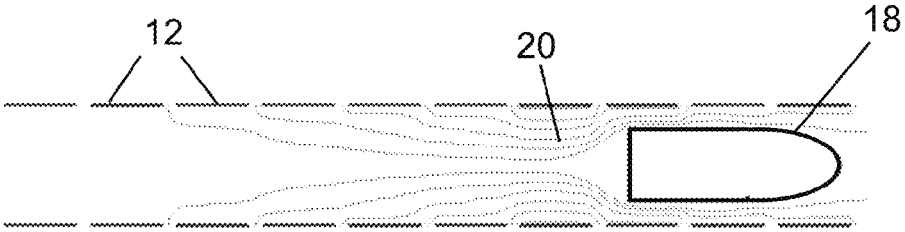

A coil gun is an electromagnetic launch device that uses a series of coaxial magnetic field-producing coils, stacked end to end to form a barrel, which are energized in sequence to accelerate or decelerate an electrically conductive projectile. FIGS. 1A through 1C illustrate a 10-stage coil gun 10 accelerating a projectile 18. The projectile 18 comprises an element (e.g., a coil, shell, ring or jacket) made of electrically conductive material (e.g., aluminum or copper), referred to herein as the "armature". In other embodiments, the armature could be a sabot. The electrically conductive projectile 18 depicted in FIGS. 1A-1C is fired conventionally using chemical propellant. To create a traveling electromagnetic wave in the barrel that is nearly synchronous with the location of the armature, a real-time detector (not shown in FIGS. 1A-1C) locates the projectile and the coil gun's firing system generates the trigger to switches that connect the individual coils to a power supply. The resulting transient electromagnetic wave induces a current in the armature. FIGS. 1A-1C show respective positions of the moving projectile 18 and lines of respective magnetic fields 20 produced by the energized coils 12 at respective instances of time.

Figure 2A:
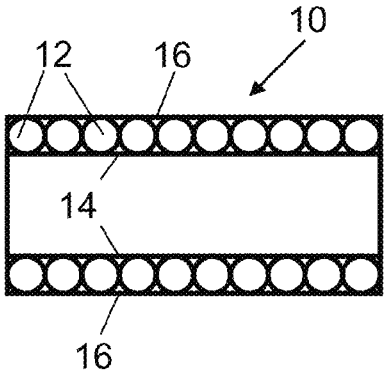
FIGS. 2A and 2B are diagrams representing sectional and end views respectively of a section of coil gun.
Figure 2B:
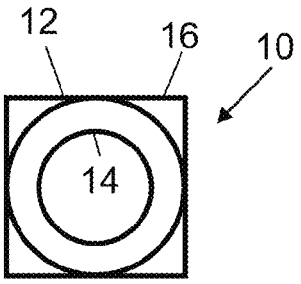

FIGS. 2A and 2B represent sectional and end views respectively of a short section of a coil gun 10. This coil gun section comprises multiple (in this example, ten) magnetic field-producing coils 12 surrounding a smooth bore barrel 14. The coils 12 are enclosed in an outer casing 16. This short section of a coil gun can be added to the end of an existing gun barrel (not shown).

A power supply (not shown in FIG. 2A) can be sequentially connected to the coils 12 by switches (also not shown) to provide short bursts of electrical energy during firing of the gun. Control electronics (not shown in FIG. 2A) in the coil gun section measure the velocity of the projectile entering the coil gun based on feedback from sensors (also not shown) and synchronize the energization of coils 12 to increase and/or regulate the muzzle velocity of the projectile.

Referring again to FIGS. 1A-1C, a coil gun is essentially a linear motor wherein the coils 12 function as the stator and the projectile 18 functions as the armature. Acceleration is accomplished by means of the Lorentz force (J×B) between the radial magnetic field from the coils 12 and the azimuthal current induced in the projectile 18. Typically coil guns are meant to be stand-alone devices that can launch projectiles to velocities in excess of 2 km/sec purely inductively using no chemical propellant. However, this does not need to be the case. A small section of coil gun of the type partly depicted in FIGS. 2A and 2B can be used to augment or precisely control the muzzle velocity of a conventional gun.

The electromagnetic assist concept presented herein can be implemented to precisely regulate the muzzle velocity of the projectile. If enough energy is available, the concept could also be implemented to significantly increase the velocity. For regulating muzzle velocity, the firing time of the coils cannot be preprogrammed (as might be done in a low-velocity coil gun) because prior to firing, it will not be known whether the projectile needs to be sped up or slowed down until it reaches the end of the barrel. The same is true if one were to use a coil gun solely to enhance the muzzle velocity. Accordingly, some way of sensing the projectile position, calculating its velocity, and then firing the coils at the appropriate time should be provided.

The primary issues with coil guns revolve around power delivery to the coils. All of the kinetic energy which a coil gun imparts to a projectile must be supplied to the coils in the form of electrical energy. This is typically done using a multiplicity of capacitor banks, each capacitor bank in turn comprising a respective multiplicity of capacitors. Each coil is energized by its own capacitor bank. These capacitor banks can be large, and as the projectile velocity increases, larger voltages and energies are required to accelerate the projectile. Switching the current can also be an issue. At low velocity and low voltage, the currents required and switching times are low enough that an ignitron or even a silicon-controlled rectifier can be used. However, for high-acceleration, high-velocity applications, the switches may need to be able to hold off more than 50 kV and switch more than $10^{11}$ A/sec.

The energy density of modern capacitors enables the production of high-voltage, high-capacity devices available in small packages. This technology enables bank energies in the 100 kJ range (suitable for muzzle velocity regulation) which can fit on a desktop. In addition, advances in switching technology have produced improved solid-state switches, such as insulated-gate bipolar transistors (IGBT) capable of actively switching (turning on and off) large currents at tens of kilovolts. In the alternative, thyratron switches can now deliver $3\times10^{12}$ A/sec at 75 kV. This is adequate to meet the needs of coil guns capable of accelerating a large mass (>3 kg) to hypervelocity (i.e., >2 km/sec).

Figure 3:
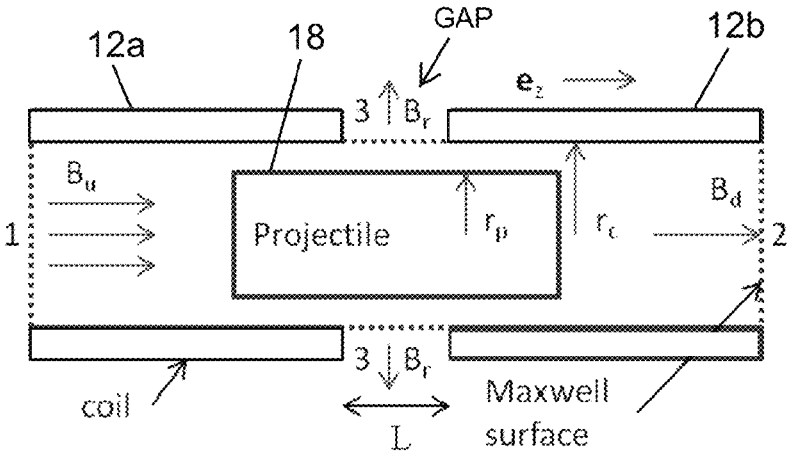
FIG. 3 is a diagram representing a projectile-coil system for solving a Maxwell stress tensor.

The following is a simple analytic model of acceleration from a coil gun using the Maxwell stress tensor to calculate the magnetic force exerted on a projectile by a series of axially spaced coils. The force on the projectile can be found by simply solving the stress tensor for the projectile-coil system schematically depicted in FIG. 3. Although FIG. 3 shows a relatively short projectile 18 surrounded by respective portions of relatively long coils 12*a* and 12*b*, the concept holds for a longer projectile inside a set of shorter coils. If there are an upstream magnetic field $B_u$ and a downstream magnetic field $B_d$, the force on the projectile is given by $$\vec{F} = \int_{surface} \ddot{T} \cdot \vec{n}\, d\text{Area} \tag{1}$$

where $\ddot{T}$ is the Maxwell stress tensor. The projectile is conducting so there is no electric field, E=0, inside the projectile 18 and the azimuthal field $B_\theta=0$ as well. The stress tensor can now be written $$\overleftrightarrow{T} = \frac{\vec{B}\vec{B}}{\mu_0} - \frac{1}{2\mu_0}\overleftrightarrow{I}(B^2) = \frac{1}{\mu_0}\begin{pmatrix} B_r^2 & 0 & B_rB_2 \\ 0 & -\frac{B^2}{2} & 0 \\ B_zB_r & 0 & B_z^2 - \frac{B^2}{2} \end{pmatrix} \tag{2}$$

Now it will be assumed for simplicity that the magnetic field at Maxwell surfaces 1 and 2 (Indicated by respective vertical dotted lines in FIG. 3) is axial only, i.e., the radial magnetic field $B_r=0$ and $B=B_z$. This is a valid assumption for the case of long coils, but not necessarily valid for short coils. The force on the projectile due to the upstream and downstream magnetic fields is $$\vec{F} = F_z = -\frac{\pi r_c^2}{2\mu_0}(B_u^2 - B_d^2) + \frac{2\pi r_c^2}{\mu_0}\int_0^L B_rB_z dz \tag{3}$$

where the Integral is over the length L of Maxwell surface 3 (indicated by horizontal dotted lines in FIG. 3). This result shows that the magnetic field tension (i.e., the first term on the right in Eq. (3)) acts to pull the projectile 18 toward the higher field. The second term on the right in Eq. (3) is the shear term due to the radial field. This is the field that accelerates the projectile 18. Since all the coil currents are azimuthal, $J=J_\theta$, the induced current in the conducting projectile, must also be azimuthal. The Lorentz force on the projectile 18 due to the axial magnetic field $B_z$ is then radial, or attempting to compress the projectile 18, while the radial magnetic field $B_r$ is axial, accelerating the projectile 18. Remembering that F=ma and solving for the acceleration on the projectile 18, we get $$\vec{a} = a_z = \frac{\pi r_c^2}{2\mu_0 m_p}\left(\frac{x_c^2}{1-x_c^2}\right)(B_u^2 - B_d^2) \tag{4}$$

where $x_c=r_p/r_c$ is a geometric coupling factor between the radius of the projectile $r_p$ and the radius of the coils $r_c$. This result satisfies a few key features. First, if no projectile is present, $r_p=0$, the system is force free as it must be. Second, it shows that there is no acceleration if $B_u=B_d$, again as it must be. Finally, it shows that if $B_u > B_d$, the projectile 18 speeds up; and if $B_u < B_d$ the projectile 18 slows down.

The result in Eq. (4) is important because it shows that a coil gun can be used to both speed up and slow down a projectile. Typically the downstream magnetic field is kept $B_d=0$ and the upstream field is increased sequentially in the coils so as to positively accelerate the projectile to a high velocity. In the context of this work, however, the desire is primarily to control the muzzle velocity of the projectile (possibly to enhance it), which may require slowing the projectile by making $B_u=0$ and increasing $B_d$.

It should be noted that Eq. (4) is only approximate for a real system. In practice, the projectile will have finite conductivity and the flux from the coils will bleed into the projectile, thereby reducing the acceleration. Also, Eq. (4) was derived using long coils, whereas in practice, coils may be short relative to the length of the projectile in order to keep the magnetic gradient and therefore the acceleration on the projectile as constant as possible. Finally, Eq. (4) provides a handy formula that can give the acceleration based on known coil and projectile geometries and magnetic fields. Other methods of calculating acceleration require more complex methods of calculating the change of mutual inductance M between the coils and the projectile:

$$F_z = i_p i_c \frac{dM}{dz} \tag{5}$$

where $i_p$ and $i_c$ are the currents in the projectile and coils respectively.

To get an idea of what kind of velocity change a coil gun may be able to achieve, it is useful to put some basic design parameters into Eq. (4). In this example, the following conditions will be assumed: a nominal muzzle velocity $v_p$=800 m/sec; projectile mass $m_p$=45 kg; armature (the conducting part of the projectile) length $l_p$=10 cm; radius $r_p$=77.5 mm; and the desired velocity correction $\Delta v$=1 m/sec. For this example, a single coil with length $l_c$=3 cm and radius $r_c$=81.5 mm will be used.

The armature will pass completely through the coil in $t_{c1}=(l_p+l_c)/v_p$=162.5 μsec. The time for half of the armature to pass into the coil is $t_{c2}=l_p/2v_p$=62.5 μsec. The rise time of the coil necessary to accelerate the projectile will be some time in between these and can be approximated by $t_c=(l_p+2l_c)/2v_p$=100 μsec. This win also be approximately the time over which the acceleration acts.

To effect $\Delta v$=1 m/sec over 100 μsec, an acceleration a=10 km/sec$^2$ is needed, which is modest. If the above parameters are put into Eq. (4), the result of the calculation is $a \approx 1750B^2$. This means that a magnetic field $B \approx 2.4$ T is needed, which is again modest. A 100-kA current in a single loop will give B~0.126 T. So to accomplish a $\Delta v$=1 m/sec in a single coil, 20 turns and about 10 kV would be needed. This is all idealized, but still very reasonable and even when one considers practical considerations of a real system, the voltages and currents required do not vary much from here. Also one should bear in mind that this is for a single coil. In actuality it would not be unreasonable to have 10 or more coils (particularly if they are only 3 cm long) in the system and the voltage, current, and turns per coil can be scaled up to allow larger $\Delta v$ (larger acceleration), or lower fields (i.e., voltage and current). It should be noted that for this example, the change in muzzle energy is about 36 kJ.

The results of the above-presented analytic model provide an idea of what may be necessary for an electromagnetic system to assist a gun to achieve more predictable muzzle velocities. The system should be capable of applying velocity corrections $\Delta v=\pm 25$ m/sec to a projectile having a nominal muzzle velocity of 800 m/sec. In the ideal case this requires an acceleration of 20 km/sec$^2$ for 1.25 msec for a system that is 1 m long. For this case one can envision a system with twenty-five coils, each 4 cm long (including the gap between coils), with each coil capable of imparting a velocity correction $\Delta v \approx \pm 1$ m/sec to the projectile.

In view of the foregoing, the magnetic field is preferably about 3.4 T in the coils. There are also coil design considerations. While more turns in a coil will increase the magnetic field for the same current, more turns will also increase the inductance, requiring a higher voltage. These conditions should be balanced given that the time the armature spends in the coil sets its rise time. This will require a few hundred kiloamperes and multi-turn coils with di/dt on the order of $10^{10}$ A/sec. The current transfer rate and coil inductance sets the voltage required for this system.

Unlike a typical coil gun that only positively accelerates a projectile, the system disclosed herein is capable of both speeding up and slowing down a projectile. In a typical coil gun, coil voltages and risetimes are tailored to the increasing velocity of the projectile. In this case all of the coils should be designed with the same risetime, voltage, and current. This should be acceptable given that one purpose is to regulate the velocity of the projectile around a nominal value and it can be assumed that under normal conditions, the projectile velocity will not be more than a few percent from that value. The amount of acceleration will be set by hardware or software that determines the initial muzzle velocity and fires or does not fire coils in such a manner as to achieve the desired acceleration.

For velocity corrections $\Delta v$=25 m/sec at a projectile velocity of 800 m/sec, the kinetic energy of the projectile would need to be changed by less than 1 MJ. This would require approximately a 2-MJ capacitor bank. Typical high-energy-density capacitors, as of the filing date, range from 1.0 to 1.8 J/cc, which would take a volume between 1 and 2 m$^3$. This bank size would easily fit in a small truck or trailer, which is not an unreasonable amount of extra support for a piece of artillery. There are a wide range of capacitors available in the voltage, current, and capacitance range required for this application that also fit this energy density. Although there are also much higher-energy-density capacitors available, their shot lifetime is, as of the filing date, too short (thousands of shots versus tens or hundreds of thousands of shots). There would be a need for generators to charge the banks between shots and rapid charging technology would be required to meet the current firing rate of common guns.

A small section of coil gun can be used to control the muzzle velocity of a conventional projectile fired from a conventional gun, such as a howitzer M777. This can be used, for example, to correct for muzzle velocity differences due to changes in powder temperature, and control the muzzle velocity to less than ±1 m/sec from the nominal velocity. This results in much greater down-range accuracy of the gun. A conventional gun can be retrofitted with a section of coil gun by forming threads on the exterior of the muzzle end of the barrel of the conventional gun and providing a coil gun section comprising a barrel extension having internal threads on the end to be attached to the gun barrel. The coil gun could then be screwed onto the end of the gun barrel and locked in place by any conventional means. Other means could be used to attach the coil gun to the gun barrel.

Figure 4:
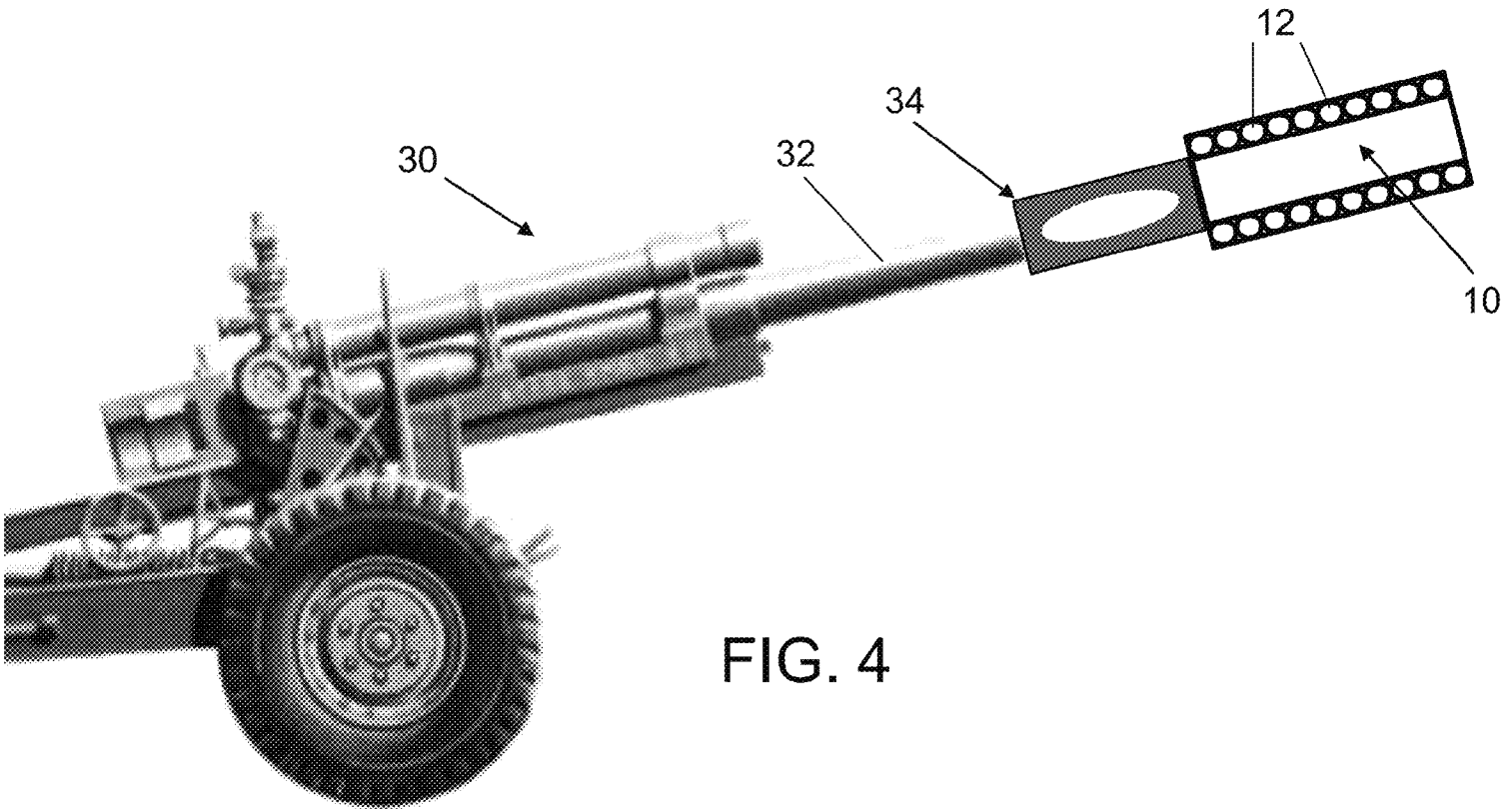
FIG. 4 is a diagram representing a side view of a howitzer equipped with a section of a coil gun at the end of a barrel.
Figure 7:
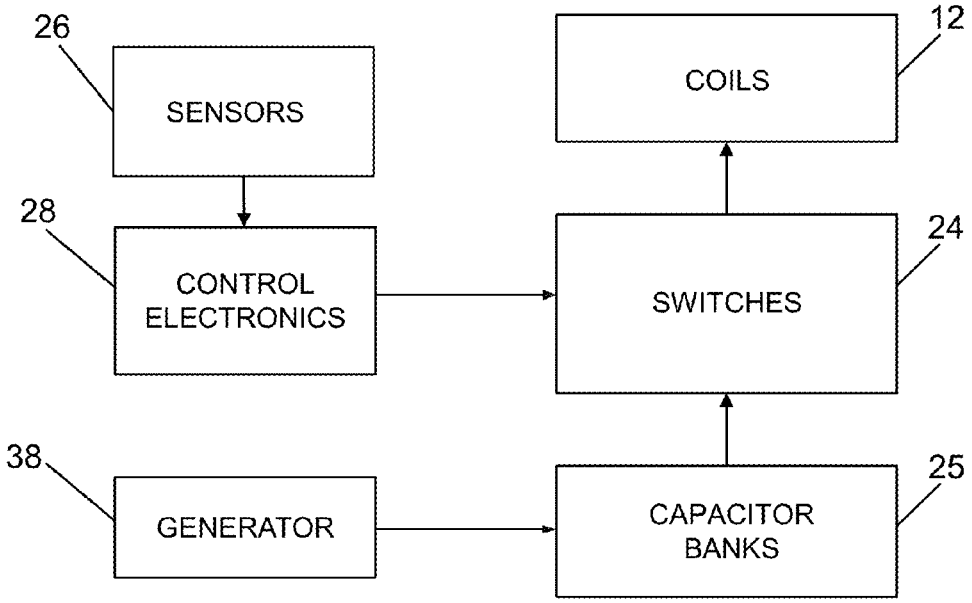
FIG. 7 is a block diagram showing electrical components of a system for providing electromagnetic assistance to a conventional gun.

FIG. 4 is a side view of a howitzer 30 equipped with a section of a coil gun 10 attached to a muzzle brake 34, which is in turn attached to the muzzle of a gun barrel 32. (A muzzle brake generally is the area at the end of a gun where the propellant gasses are vented as the projectile leaves the muzzle.) The coil gun 10 may comprise a multiplicity of coils 12 arranged as shown in FIG. 2A. The coil gun 10 may further comprise two or more position sensors for detecting when a portion of launched projectile arrives at respective axial positions relative to the muzzle. For example, a pair of sensors may be mounted to the muzzle brake 34 to provide feedback data from which the muzzle velocity of a projectile can be determined. Additional sensors can be provided inside the section of coil gun 10 for detecting the present velocity of the projectile at various axial positions along the coil gun axis. The power supply (e.g., capacitor banks charged by a generator) and control electronics for energizing the coils 12 are not shown in FIG. 4, but would be arranged as generally depicted in FIG. 7). The coils 12 can be energized in various ways to achieve a desired adjustment of the projectile velocity in dependence on the present velocity of the projectile, as will be described in more detail below with reference to FIGS. 9 and 10.

Figure 5:
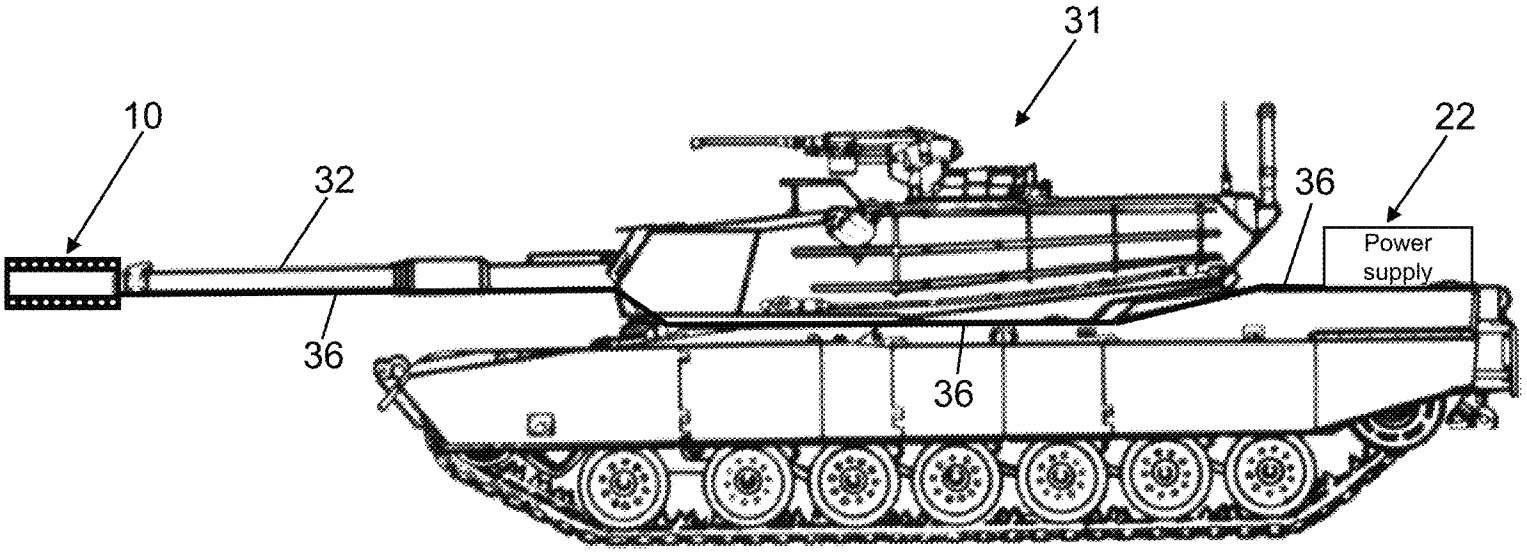
FIG. 5 is a diagram representing a side view of an M1 Abrams tank equipped with a section of a coil gun at the end of a barrel.

FIG. 5 is a side view of an M1 Abrams tank 31 equipped with a section of a coil gun 10 attached to the muzzle of a gun barrel 32. The coil gun 10 may comprise a multiplicity of coils 12 arranged as shown in FIG. 2A. The coil gun 10 may further comprise two or more position sensors for detecting when a portion of launched projectile arrives at respective axial positions relative to the muzzle. For example, a pair of sensors may be disposed between the muzzle of gun barrel 32 and the start of the first coil of coil gun 10 to provide feedback data from which the muzzle velocity of a projectile can be determined. Additional sensors can be provided inside the section of coil gun 10 for detecting the present velocity of the projectile at various axial positions along the coil gun axis. The power supply 22 may be mounted on the exterior of a rear portion of the tank 31 and connected to the coil gun 10 by means of an electrical cable 36, as shown in FIG. 5. The control electronics for selectively energizing the coils to produce a desired electromagnetic force are not shown in FIG. 5, but will be described later with reference to FIGS. 7 and 8. The coils 12 can be energized in various ways to achieve a desired adjustment of the projectile velocity in dependence on the present velocity of the projectile, as will be described in more detail below with reference to FIGS. 9 and 10.

Figure 6:
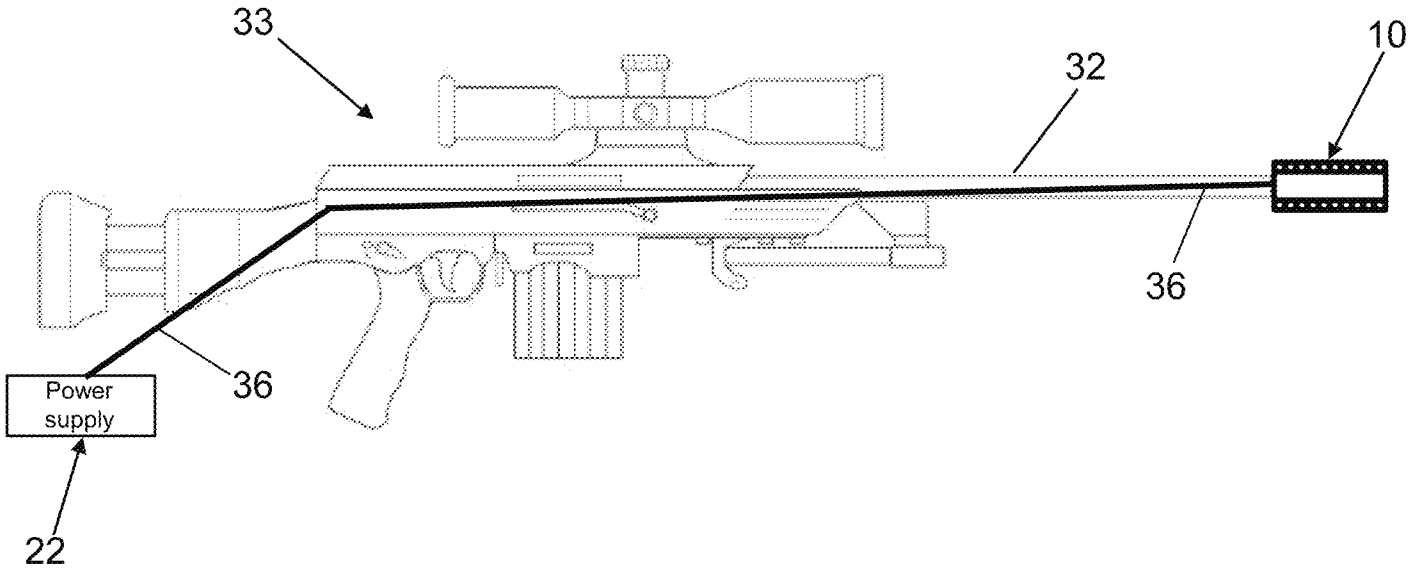
FIG. 6 is a diagram representing a side view of a sniper rifle equipped with a section of a coil gun at the end of a barrel.

FIG. 6 is a side view of a sniper rifle 33 equipped with a section of a coil gun 10 at the end of a gun barrel 32. Again the coil gun 10 may comprise a multiplicity of coils 12 arranged as shown in FIG. 2A. The coil gun 10 may further comprise two or more position sensors for detecting when a portion of a bullet arrives at respective axial positions relative to the muzzle. For example, a pair of sensors may be disposed between the muzzle of gun barrel 32 and the start of the first coil of coil gun 10 to provide feedback data from which the muzzle velocity of a bullet can be determined. Additional sensors can be provided inside the section of coil gun 10 for detecting the present velocity of the bullet at various axial positions along the coil gun axis. A power supply 22 may be connected to the coil gun 10 by means of an electrical cable 36, as shown in FIG. 6. The control electronics for selectively energized the coils to produce a desired electromagnetic force are not shown in FIG. 6, but will be described later with reference to FIGS. 7 and 8. The coils of coil gun 10 can be energized in various ways to achieve a desired adjustment of the projectile velocity in dependence on the present velocity of the projectile, as will be described in more detail below with reference to FIGS. 9 and 10.

Basic calculations would show that the electromagnetic assistance concept disclosed herein is practical in terms of size of coils, size of capacitor banks, bank energy, current, and voltage. In the case of tanks and howitzers, the coils themselves can total about a meter in length and the banks themselves, with moderately high-energy-density capacitors, can fit on a tank or in a small truck or trailer that would accompany a howitzer.

FIG. 7 shows some electrical components of a system for providing electromagnetic assistance to a conventional gun that utilizes chemical propellant. A power supply can be sequentially connected to the coils 12 by a multiplicity of switches 24 to provide short bursts of electrical energy (i.e., current pulses) during firing of the gun. The switches 24 may comprise insulated-gate bipolar transistors, thyratron switches, or other suitable switches. In accordance with the embodiment shown in FIG. 7, the power supply comprises a multiplicity of capacitor banks 25 charged by a generator 38. Each capacitor bank 25 comprises a respective multiplicity of capacitors. Each of the switches 24 is connected to a respective coil 12 and to a respective capacitor bank 25. Control electronics 28 in the coil gun section measure the velocity of the projectile entering the coil gun based on feedback from sensors 26 and synchronize the dosing of switches 24 and the firing of coils 12 to increase and/or regulate the muzzle velocity of the projectile. More specifically, the sensors 26 may include a first sensor configured and located to send a first signal when a portion of a projectile arrives at a first axial position at a first time and a second sensor configured to send a second signal when the same portion of the projectile arrives at a second axial position at a second time subsequent to the first time. Based on the information represented by the characteristics of the first and second signals, the control electronics 28 can alter the states of one or more of the multiplicity of switches 24 to produce electromagnetic forces for adjusting the velocity of an electrically conductive projectile.

In accordance with some embodiments, the control electronics 28 are programmed or configured to perform the following operations: (a) generate a signal representing a present velocity of the projectile based on first and second signals; (b) compare the signal representing a present velocity of the projectile with a signal representing a target velocity of the projectile; and (c) generate switching control signals for controlling the states of the switches 24 in a manner that causes the coils 12 to generate electromagnetic forces that reduce a difference between the present and target velocities. Operation (a) may comprise calculating the present velocity based on a distance between the first and second sensors and a time interval separating the first and second times. The states of the switches 24 can be controlled to cause at least one of the coils 12 to generate an electromagnetic force which will increase or decrease the velocity of a projectile depending on whether the present velocity is less or greater than the target velocity.

It should be appreciated that the control electronics 28 may be implemented in hardware, software or firmware. For example, the controller may comprise a computer or a processor programmed to perform calculations and execute operations. In the alternative, the controller may take the form of hard-wired control units implemented through use of sequential logic units, featuring a finite number of gates that can generate specific results based on the instructions that were used to invoke those responses. Hard-wired control units have a fixed architecture, i.e., they require changes in the wiring if the instruction set is modified or changed.

Figure 8:
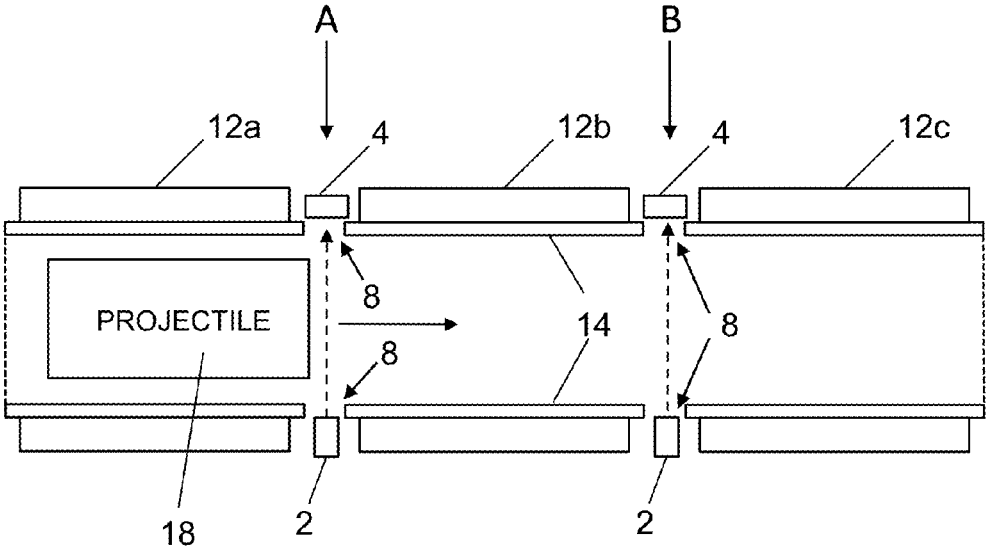
FIG. 8 is a diagram representing a projectile-coil system that uses optical detection of the axial position of a launched projectile.

FIG. 8 is a diagram representing a projectile-coil system that uses optical detection of the axial position of a launched projectile 18. FIG. 8 shows a projectile 18 inside a smooth bore of a barrel extension 14 of a coil gun. The projectile 18 has a velocity vector which is indicated by the horizontal solid arrow in FIG. 8. Respective portions of the barrel extension 14 are surrounded by a multiplicity of coils. FIG. 8 only shows three coils 12*a*, 12*b* and 12*c*; other coils and the rest of the barrel extension are not shown. The barrel extension 14 is coupled to a gun barrel (not shown in FIG. 8) such that the smooth bore of the barrel extension 14 is aligned with a smooth bore of the gun barrel.

In an embodiment that regulates the projectile velocity, the coils may be configured to have the same risetime, voltage, and current. For an embodiment that increases the projectile velocity, those parameters would need to change for coils downstream of the projectile for increased velocity.

The coil gun partly depicted in FIG. 8 is equipped with a multiplicity of sensors, which may be placed in a multiplicity of pairs of diametrally opposed openings 8 formed in the barrel extension 14. The opening 8 may be formed in the gaps between neighboring coils. FIG. 8 depicts two pairs of openings respectively centered at axial positions A and B (indicated by downward solid arrows in FIG. 8). In the implementation shown in FIG. 8, each sensor comprises a respective light emitter 6 and a respective photodetector 4 arranged to receive light (indicated by upward dashed arrows in FIG. 8) from the respective light emitter 6 in the absence of an Intervening obstruction. (There are also proximity sensors that can be used, that also use a light emitter and detector, but they detect light reflected off the projectile instead of when the light is blocked.) When the nose of the projectile 18 intersects the path of the light directed toward a photodetector 4, the light will become obstructed and the electrical signal being output by the photodetector 4 will cease at the instant in time when the nose of the projectile crosses that path. Thus the photodetectors 4 seen in FIG. 8 can produce first and second signals which indicate the respective instances in time when the nose of the projectile arrived at axial positions A and B. The first signal can be used to generate a starting pulse for a digital counter and the second signal can be used to generate a stop pulse for the digital counter. The resulting count represents the duration of time for the projectile to travel a distance equal to the distance separating axial positions A and B. Thus the present projectile velocity can be calculated by dividing the separation distance by the duration of time.

In the alternative, external laser-based diagnostics could be used to monitor the position and velocity of the projectile in a coil gun during launch. The energizing of each coil is then based on the true position of the projectile with respect to the coils to provide optimum thrust. The coils are only energized if the projectile's present velocity falls outside an accepted tolerance band around a target velocity. The coils can be energized to adjust the project velocity to achieve a desired precision relative to a target velocity.

The switching configurations could be pre-stored or switch closure times could be computed on the fly. Respective examples of such switching configurations will now be described with reference to FIGS. 9 and 10.

Figure 9:
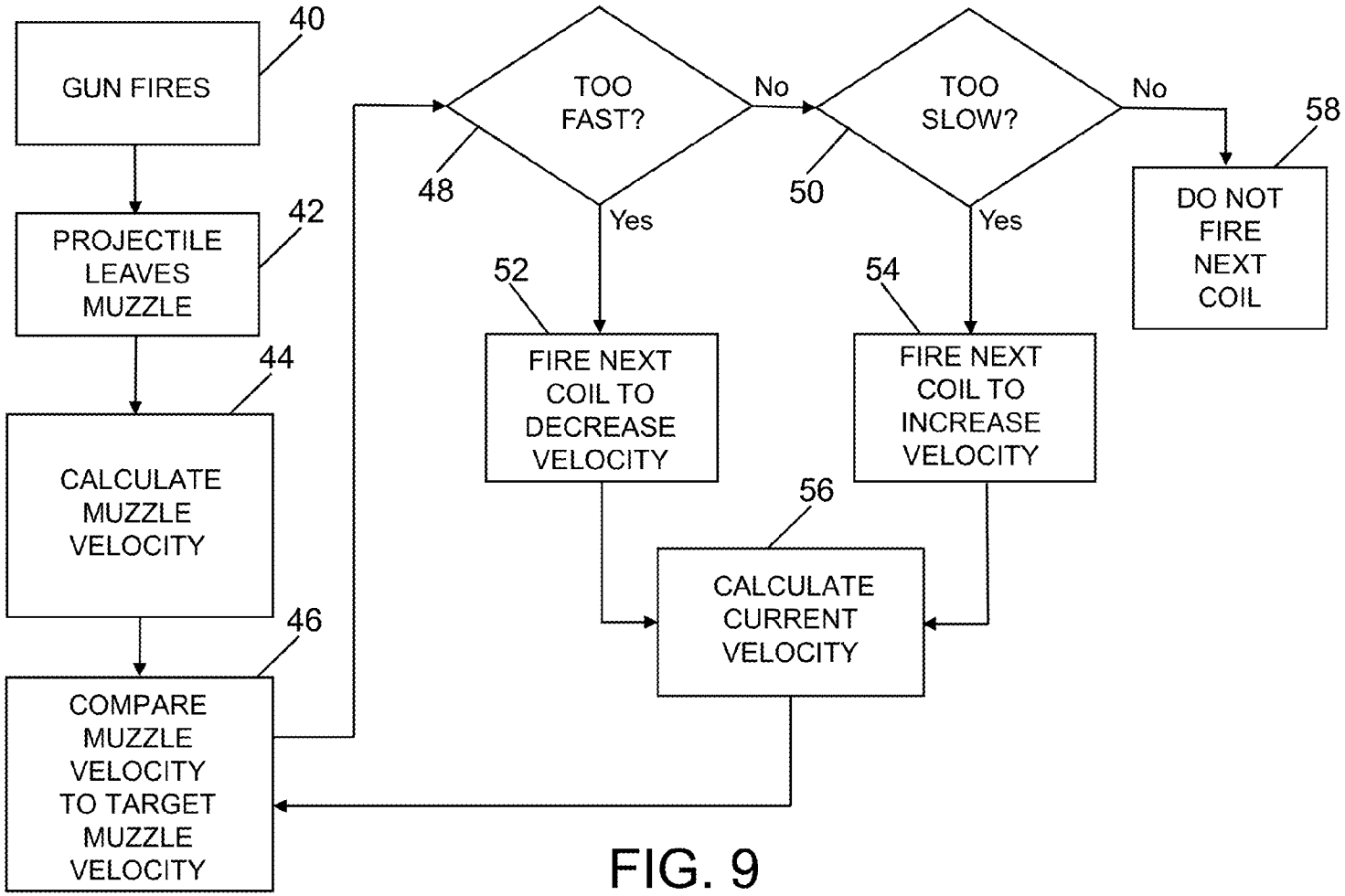
FIG. 9 is a flowchart indicating steps of a process for electromagnetically achieving a target muzzle velocity of a projectile using sensor feedback.

FIG. 9 is a flowchart indicating steps of a process for electromagnetically achieving a target muzzle velocity of a projectile using sensor feedback. More specifically, the method entails adjusting a velocity of a projectile propelled by a gun using chemical propellant. First, chemical propellant is ignited to cause a projectile to be propelled from a breech to a muzzle of a gun barrel (step 40 in FIG. 9). As the projectile exits the muzzle (step 42), sensors detect respective first and second times of arrival of the projectile at first and second axial positions respectively. Based on this time information and the distance separating the first and second axial positions, the muzzle velocity is calculated (step 44). The calculated muzzle velocity is then compared to a target muzzle velocity (step 46). Next, a determination is made whether the calculated muzzle velocity is greater than the target muzzle velocity (step 48). If the calculated muzzle velocity is greater than the target muzzle velocity, then the control electronics will cause the next coil (which may be the first coil) to be fired (i.e., energized) to decrease the velocity of the projectile by generating an electromagnetic force in a space that is forward of the muzzle (step 52). If a determination is made in step 48 that the calculated muzzle velocity is not greater than the target muzzle velocity, then a determination is made whether the calculated muzzle velocity is less than the target muzzle velocity (step 50). If the calculated muzzle velocity is less than the target muzzle velocity, then the control electronics will cause the next coil (which may be the first coil) to be fired (i.e., energized) to increase the velocity of the projectile by generating an electromagnetic force in a space that is forward of the muzzle (step 54). If a determination is made in step 50 that the calculated muzzle velocity is not less than the target muzzle velocity, then the next coil is not fired (step 58).

After the next coil has been fired, the present velocity of the projectile can be calculated based, for example, on old information from the sensor at the second axial position and new information from a sensor situated at a third axial position (step 56). The newly calculated present projectile velocity is then again compared to the target muzzle velocity (step 46). Steps 46, 48, 50, 52, 54 and 56 are iteratively performed until the present projectile velocity is within a specified tolerance of the target muzzle velocity, i.e., until the present velocity differs from the target velocity by less than a specified threshold.

Figure 10:
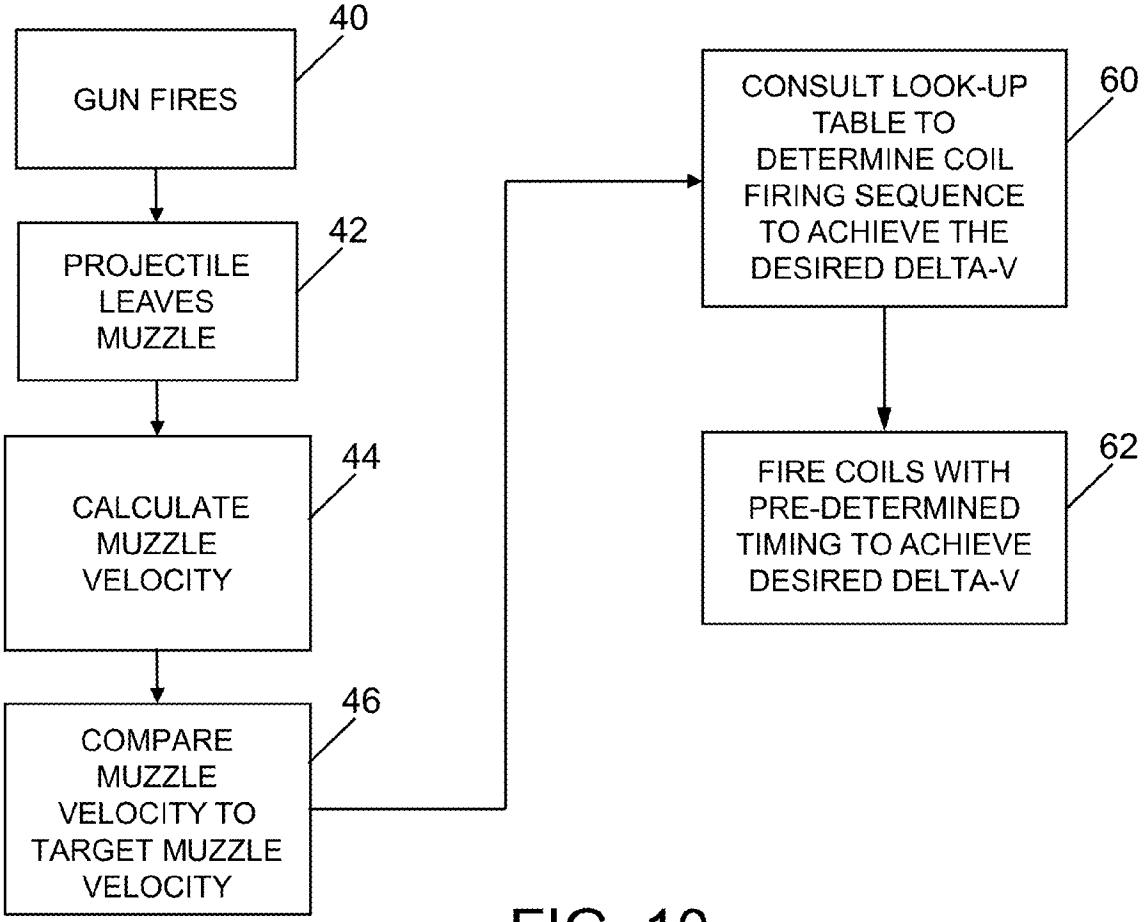
FIG. 10 is a flowchart indicating steps of a process for electromagnetically achieving a target muzzle velocity of a projectile using a look-up table.

FIG. 10 is a flowchart indicating steps of a process for electromagnetically achieving a target muzzle velocity of a projectile using a look-up table. First, chemical propellant is ignited to cause a projectile to be propelled from a breech to a muzzle of a gun barrel (step 40 in FIG. 10). As the projectile exits the muzzle (step 42), sensors detect respective first and second times of arrival of the projectile at first and second axial positions respectively. Based on this time information and the distance separating the first and second axial positions, the muzzle velocity is calculated (step 44). The calculated muzzle velocity is then compared to a target muzzle velocity and the difference between those velocities is computed (step 46). Next, the velocity difference is input as an address to a look-up table that stores a multiplicity of specified timing sequences for firing of the coils of the coil gun (step 60). Based on the input address, a predetermined timing sequence is read out from the look-up table. The coils are then fired in accordance with that timing sequence (step 62) to achieve the desired change (i.e., delta) in velocity of the projectile.

While systems and methods for electromagnetically assisting the launching of chemically propelled projectiles have been described with reference to various embodiments, it will be understood by those skilled in the art that various changes may be made and equivalents may be substituted for elements thereof without departing from the scope of the claims set forth hereinafter. In addition, many modifications may be made to adapt the teachings herein to a particular situation without departing from the scope of the claims.

The method claims set forth hereinafter should not be construed to require that the steps recited therein be performed in alphabetical order (alphabetical ordering in the claims is used solely for the purpose of referencing previously recited steps) or in the order in which they are recited. Nor should they be construed to exclude two or more steps or portions thereof being performed concurrently or to exclude any portions of two or more steps being performed alternatingly.

As used in the claims, the term "velocity" means the magnitude of the velocity vector, i.e., speed, and is not intended to require direction information, which is assumed to be constant during firing of the projectile. As used in the claims, the term "muzzle" means the end of a gun barrel from which the projectile will exit.

The invention claimed is:

1. A system that is capable of firing a projectile using chemical propellant, comprising:

a gun barrel having a muzzle and an axis;

a barrel extension attached to said muzzle of said gun barrel, said barrel extension having an axis which is coaxial with said axis of said gun barrel;

a multiplicity of electrically conductive coils arranged in sequence along said axis of said barrel extension and surrounding respective axial portions of said barrel extension;

a multiplicity of sources of electrical current;

a multiplicity of switches, each of said switches being connected to a respective coil and to a respective source of electrical current;

a sensor system for detecting positions of a projectile as it exits said muzzle; and control electronics programmed or configured to alter the state of one or more of said multiplicity of switches based on signals output by said sensor system.

2. The system as recited in claim 1, wherein said control electronics are programmed or configured to perform the following operations:

(a) generate data representing a present velocity of the projectile based on said signals from said sensor system;

(b) compare said data representing a present velocity of the projectile with data representing a target velocity of the projectile; and (c) generate switching control signals for controlling the state of said switches in a manner that causes said coils to generate electromagnetic forces that reduce a difference between the present and target velocities.

3. The system as recited in claim 2, wherein said sensor system comprises:

a first sensor configured and located to send a first signal when a portion of a projectile arrives at a first axial position at a first time; and a second sensor configured and located to send a second signal when said portion of the projectile arrives at a second axial position at a second time subsequent to said first time, wherein operation (a) comprises calculating the present velocity based on a distance between said first and second sensors and a time interval separating said first and second times.

4. The system as recited in claim 2, wherein the states of said switches are controlled to cause at least one of said coils to generate an electromagnetic force which will increase the velocity of a projectile when the present velocity is less than the target velocity.

5. The system as recited in claim 2, wherein the states of said switches are controlled to cause at least one of said coils to generate an electromagnetic force which will decrease the velocity of a projectile when the present velocity is greater than the target velocity.

6. The system as recited in claim 1, wherein said coils are configured to have the same risetime, voltage, and current when the control electronics are programmed or configured to regulate projectile velocity.

7. The system as recited in claim 1, wherein each of said sources of electrical current comprises a respective capacitor bank, each of said capacitor banks being connected to a respective switch.

8. The system as recited in claim 3, wherein each of said first and second sensors comprises a respective light emitter and a respective photodetector arranged to receive light from said respective light emitter.

9. The system as recited in claim 1, wherein said gun barrel is a part of a tank, howitzer, naval gun, rifle, or other large gun.

10. A system that is capable of firing a projectile using chemical propellant, comprising:

a first gun barrel section having a breech and a muzzle;

a second gun barrel section coupled to and aligned with said first gun barrel section;

a multiplicity of electrically conductive coils arranged in sequence along said second gun barrel section and surrounding respective axial portions of said second gun barrel section;

a multiplicity of capacitor banks;

a multiplicity of switches, each of said switches being connected to a respective coil and to a respective capacitor bank;

a sensor system for detecting positions of a projectile as it exits said muzzle; and control electronics programmed or configured to alter the state of one or more of said multiplicity of switches based on signals output by said sensor system.

11. The apparatus as recited in claim 10, further comprising a muzzle brake attached to and disposed between said first and second gun barrel sections.

12. The apparatus as recited in claim 10, wherein said first gun barrel section is a barrel of a tank, a howitzer, a rifle, naval gun, or other large gun.

13. The system as recited in claim 10, wherein said control electronics are programmed or configured to perform the following operations:

(a) generate data representing a present velocity of the projectile based on said signals from said sensor system;

(b) compare said data representing a present velocity of the projectile with data representing a target velocity of the projectile; and (c) generate switching control signals for controlling the state of said switches in a manner that causes said coils to generate electromagnetic forces that reduce a difference between the present and target velocities.

14. The system as recited in claim 13, wherein said sensor system comprises:

a first sensor configured and located to send a first signal when a portion of a projectile arrives at a first axial position at a first time; and a second sensor configured and located to send a second signal when said portion of the projectile arrives at a second axial position at a second time subsequent to said first time, wherein operation (a) comprises calculating the present velocity based on a distance between said first and second sensors and a time interval separating said first and second times.

15. The system as recited in claim 14, wherein each of said first and second sensors comprises a respective light emitter and a respective photodetector arranged to receive light from said respective light emitter.

16. The system as recited in claim 13, wherein the states of said switches are controlled to cause at least one of said coils to generate an electromagnetic force which will increase the velocity of a projectile when the present velocity is less than the target velocity.

17. The system as recited in claim 13, wherein the states of said switches are controlled to cause at least one of said coils to generate an electromagnetic force which will decrease the velocity of a projectile when the present velocity is greater than the target velocity.

18. The system as recited in claim 10, wherein said coils are configured to have the same risetime, voltage, and current when the control electronics are programmed or configured to regulate projectile velocity.

* * * * *